US005400061A

United States Patent [19]

Horio et al.

[11] Patent Number: 5,400,061

[45] Date of Patent: Mar. 21, 1995

[54] INK-JET PRINTER HEAD

[75] Inventors: Hideaki Horio, Fukuoka; Masaharu Ooyama, Chikushino; Mitsuhide Matsuda; Masaya Iwasaki, both of Fukuoka, all of Japan

[73] Assignee: Matsushita Electric Industrial Co., Ltd., Osaka, Japan

[21] Appl. No.: 863,115

[22] Filed: Apr. 3, 1992

[30] Foreign Application Priority Data

Apr. 5, 1991 [JP] Japan ..... 3-072005

[51] Int. Cl.[6] ..... B41J 2/06

[52] U.S. Cl. ..... 347/55

[58] Field of Search ..... 346/75, 140 R; 347/54, 347/55

[56] References Cited

U.S. PATENT DOCUMENTS

| | | | |
|---|---|---|---|
| 3,179,042 | 4/1965 | Naiman | 346/75 |
| 4,575,737 | 3/1986 | Vermot-Gaud et al. | 346/140 R |
| 4,595,938 | 6/1986 | Conta et al. | 346/140 R |
| 5,144,340 | 9/1992 | Hotomi et al. | 346/140 R |

FOREIGN PATENT DOCUMENTS

| | | |
|---|---|---|
| 60-19539 | 1/1985 | Japan . |
| 0193352 | 8/1991 | Japan . |
| 0203656 | 9/1991 | Japan . |

*Primary Examiner*—Benjamin R. Fuller
*Assistant Examiner*—Alrick Bobb
*Attorney, Agent, or Firm*—Pollock, Vande Sande & Priddy

[57] ABSTRACT

An improved ink-jet printer of the so-called current flow type wherein a current is passed through a conductive ink contained between a pair of electrodes so as to cause the ink to become vaporized and cause trapped gasses or bubbles to expand suddenly, exerting a sufficient pressure upon the ink to force a droplet of ink from a nozzle is disclosed, wherein at least one projection of electrically insulating material is disposed between the pair of electrode for increasing the density of the current at a position directly below a nozzle. With the projection thus provided, only a limited portion of the conductive ink participates in the generation of heat, and boiling of the conductive ink takes place only at the position directly below the nozzle. Accordingly, droplets of conductive ink are produced with minimum power consumption and can be ejected in a uniform direction. The position where boiling of the conductive ink takes place is remote from the electrodes, so that the electrodes are substantially free from cavitation and thermal shock and, hence, they have a long life span.

31 Claims, 4 Drawing Sheets

INK-JET PRINTER HEAD

BACKGROUND OF THE INVENTION

1. Field of the Invention

The present invention relates generally to bubble jet printing systems that use the volume change of bubbles produced by heating in order to spray small jets of conductive ink, and more particularly to an ink-jet head of such an ink-jet printer of the so-called "current-flow" type wherein a current is passed through a conductive ink to cause the ink to become vaporized and cause any trapped gases or bubbles to expand, forcing droplets of ink to spout from the ink-jet head.

2. Description of the Prior Art

With a growing demand for a quick, quiet and color-printout printer, interest has been shown towards ink-jet printers recently.

The ink-jet printers are generally classified into two groups, one being the continuous type and the other being the on-demand type. The on-demand type ink-jet printer is further divided, according to the driving system, into Kyser type, Stemme type, and Gould type, all types that are driven by a piezoelectric device, and a bubble jet type in which a conductive ink is ejected using volume change of a bubble produced on heating.

The bubble jet type ink-jet printer is further classified into two groups according to the heating system. The first group is called "thermal head type" in which a heater is used for heating the conductive ink, while the second group is called "current-flow type" using a current flowing through the conductive ink to cause the conductive ink to generate heat, A typical example of ink-jet heads used in the conventional current-flow type ink-jet printers will be described below with reference to FIGS. 6 and 7 of the accompanying drawings.

FIG. 6 is a fragmentary cross-sectional view of the conventional ink-jet head, and FIG. 7 is a cross-sectional view taken along line VII—VII of FIG. 6. The ink-jet head includes a base plate 1 on which a heat-insulating layer 2 is laminated. A nozzle plate 4 having a plurality of discharge holes 3 (only one being shown) is disposed in parallel spaced relation to the base plate 1. A plurality of pairs of opposed electrodes 5 (only one electrode pair being shown) arranged in a predetermined pattern or matrix are disposed on an upper surface of the heat-insulating layer 2, with each of the individual pairs of electrodes 5 being located at a position corresponding to the position of one of the discharge holes 3. Each of the electrode pairs 5 is composed of a signal electrode 5A and a common electrode **5*b* confronting one another with a predetermined space or gap therebetween. A partition member 6 made of an electrically insulating material is disposed between the heat-insulating layer 2 and the nozzle plate 4 so as to isolate the individual discharge holes 3 from one another against interference. The heat-insulating layer 2, partition member 6 and nozzle plate 4 jointly define therebetween a plurality of pressure chambers 7 (only one being shown) each of which communicates with an ink passage 8, so that a conductive ink is introduced into the pressure chamber 7 through the ink passage 8. In FIG. 6, reference numeral 10 is a pulse voltage generator by means of which a voltage from a DC power supply 11 is selectively applied to the opposed electrodes 5**.

Reference character a designates electric lines of force, also known as electric flux lines, passing through a portion of the conductive ink contained between the signal electrode 5A and the common electrode 5B. The signal electrodes 5A and the common electrode 5B define therebetween a current flow passage A which is dimensioned by the distance D (FIG. 7) between the electrodes 5A, 5B, the width W of the electrodes 5A, 5B and the height H (FIG. 6) of the electrodes 5A, 5B.

With this arrangement, when a current flows along the electric lines of force a, the conductive ink contained in the current flow channel A is caused to evolve heat and become vaporized, thereby producing bubbles. The bubbles thus formed raises the pressure in the pressure chamber 7, forcing a droplet 9 of ink from the discharge hole 3 of the ink-jet head.

Operation of the conventional ink-jet head of the foregoing construction will be described below in greater detail.

When a pulse voltage is applied from the pulse voltage generator 10 to the signal electrode 5A and the common electrode 5B, a current is passed through the current flow passage A along electric lines a of force created between the electrodes 5A and 5B. The current causes that portion of the conductive ink contained in the current flow passage A to evolve heat and then become vaporized, thereby producing bubbles (not shown). Due to the bubbles thus produced, the pressure in the pressure chamber 7 rises suddenly so that a droplet 9 of ink is forced from the discharge hole 3 onto the surface of a recording paper (not shown) placed above the ink-jet head, thus forming a dot of a character to be printed on the recording paper. After ejection of the conductive ink, an adequate amount of conductive ink is replenished from the ink passage 8 to the pressure chamber 7 so that the pressure chamber 7 is always filled with the conductive ink.

The conventional ink-jet head, however, has drawbacks as described below. Due to the shape and configuration of the current flow passage A, the conductive ink contained in the current flow passage A generates heat uniformly over the entire area thereof. This means that the whole of the conductive ink contained in the current flow channel A are participated in the generation of heat and must evolve heat above a boiling point in order to produce bubbles. Thus, a large amount of power is dissipated as heat and hence the energy efficiency is low. In addition, due to the uneven shape and configuration of the electrodes 5, due to deterioration of the electrodes 5, or due to the uneven shape and configuration of the pressure chambers 7, bubbles produced on boiling of the conductive ink tend to distribute unevenly over the entire area of each of the current flow passage A. With this uneven distribution of bubbles, droplets of ink are liable to be ejected in different directions and with different sizes. In order to produce uniformly distributed bubbles, the distance D (FIG. 7) between the signal electrode 5A and the common electrode 5B and the width W of the electrodes 5A, 5B must be smaller than 50 μm, or end surfaces of the respective electrodes 5A, 5B must be finished precisely. In either case, an additional production cost is needed, resulting in an expensive ink-jet heat.

SUMMARY OF THE INVENTION

With the foregoing drawbacks of the prior art in view, it is an object of the present invention to provide an ink-jet printer of the current-flow type which is capable of ejecting small jets of conductive ink stably in a uniform direction and with a uniform size, is excellent in energy efficiency and can be manufactured at a low cost.

According to the invention, there is provided an ink-jet for an ink-jet printer, comprising: an ink tank for holding therein a conductive ink; a nozzle associated with the ink tank for ejecting a droplet of the conductive ink; a pair of electrodes disposed on an inside surface of the ink tank at a position corresponding to the position of the nozzle; first means for applying a voltage to the pair of electrodes to cause a current to be passed through the conductive ink contained between the pair of electrodes; and second means disposed between the electrodes for increasing the current density of the current.

The second means includes a projection made of an electrically insulating material and disposed between the pair of electrodes, the projection having a peak sloping down toward the pair of electrodes. The peak is preferably disposed centrally between the pair of electrodes. It is preferable that the peak is disposed directly below the nozzle. According to a preferred embodiment, the projection is in the form of a convex resembling a part of a sphere. The projection may be in the form of a convex resembling a part of a cylinder and having a peak extending in a direction perpendicular to a common longitudinal axis of the pair of electrodes. Preferably, the peak of the projection lies flush with upper surfaces of the pair of electrodes.

According to a preferred embodiment, the second means further includes two confronting second projections each projecting between the pair of electrodes from a plane perpendicular to a plane from which the first projection projects. The second projections have peaks which define therebetween a recess extending above the first projection in a direction parallel to a common longitudinal axis of the pair of electrodes. Preferably, the peaks of the second projections merge with the peak of the first projection.

The above and other objects, features and advantages of the present invention will become more apparent from the following description when making reference to the detailed description and the accompanying sheets of drawings in which preferred structural embodiments incorporating the principles of the present invention are shown by way of illustrative example.

DETAILED DESCRIPTION OF THE INVENTION

The present invention will be described hereinbelow in greater detail with reference to a preferred embodiment shown in FIGS. 1 through 4.

Figure 1:
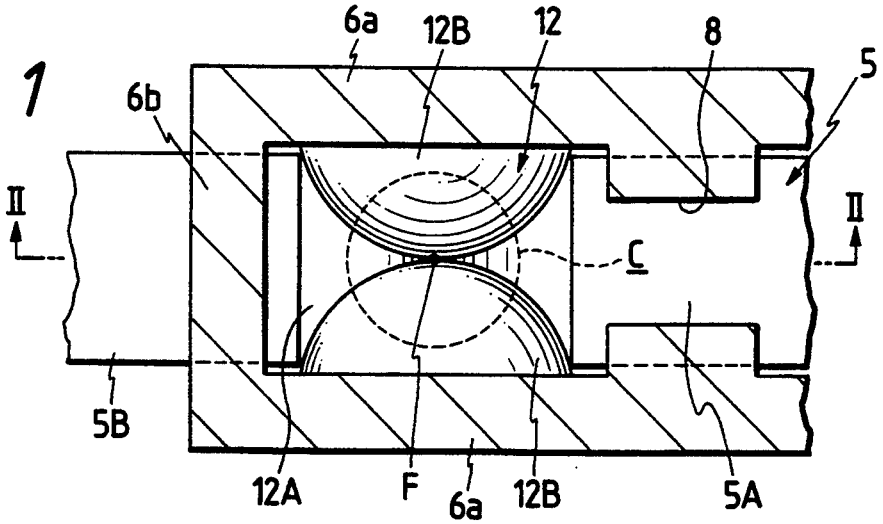
FIG. 1 is a cross-sectional view of an ink-jet head for an ink-jet printer according to the present invention.
Figure 2:
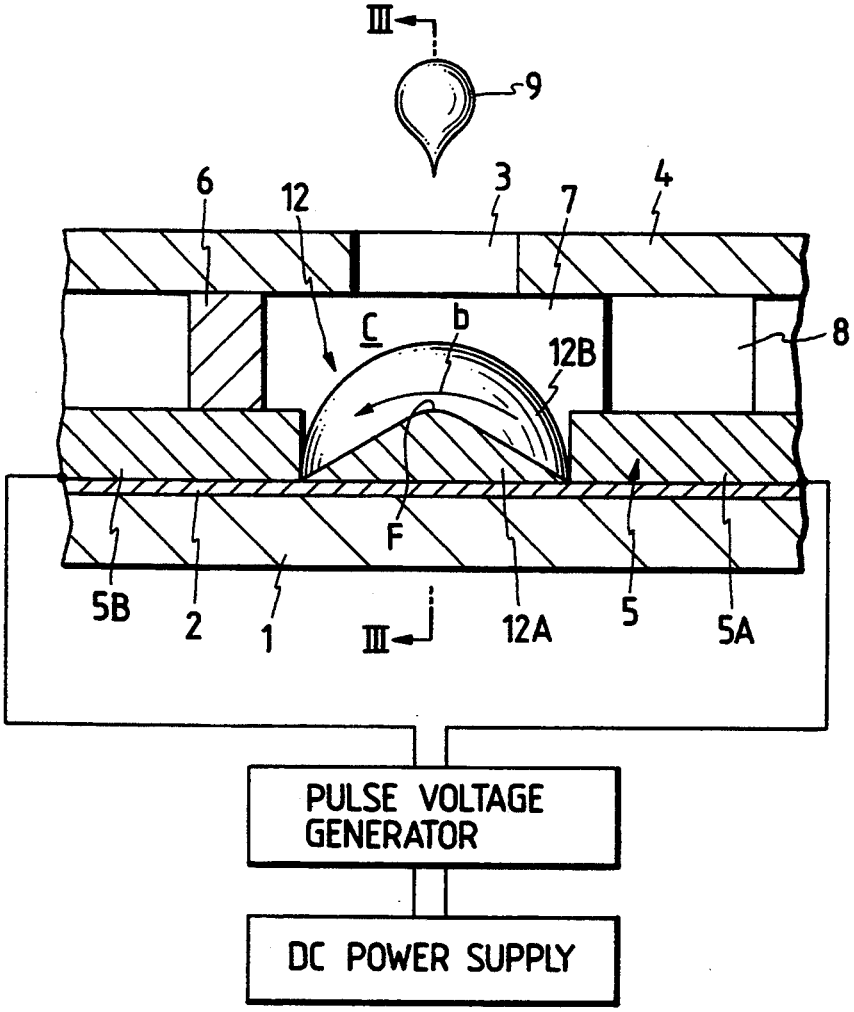
FIG. 2 is a cross-sectional view taken along line II—II of FIG. 1.
Figure 3:
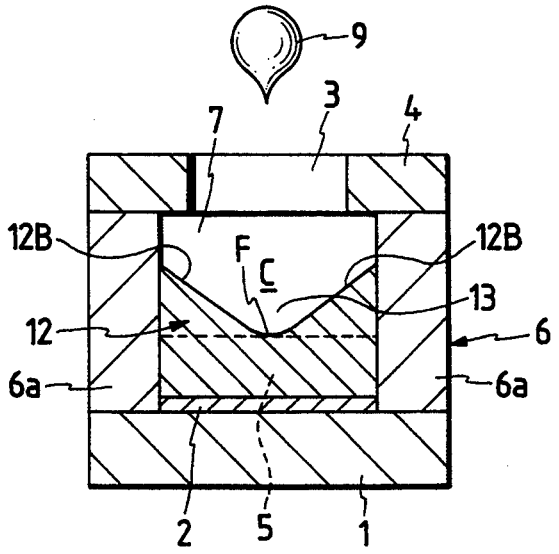
FIG. 3 is a cross-sectional view taken along line III—III of FIG. 2.

As shown in FIG. 2, an ink-jet head according to the present invention includes a base plate 1, a heat-insulating layer 2 laminated on an upper surface of the base plate 1, and a nozzle plate 4 disposed in confrontation with the base plate 1 with a predetermined space therebetween. The nozzle plate 4 has a plurality of discharge holes or nozzles 3 (only one being shown). Disposed on an upper surface of the heat-insulating layer 2 are a plurality of pairs of opposed electrodes 5 (only one electrode pair being shown) arranged in a predetermined pattern. Each of the individual pairs of electrodes 5 is disposed at a position corresponding to the position of one of the discharge holes 3 in the nozzle plate 4. Each of the electrode pairs 5 is composed of a signal electrode 5A and a common electrode 5B confronting one another with a space or gap therebetween. The electrodes 5A and 5B have a same height, and front surfaces of the respective electrodes 5A, 5B extend parallel to one another. A partition member 6 made of an electrically insulating material is disposed between the heat-insulating layer 2 and the nozzle plate 4 so as to isolate the discharge hole 3 from another discharge hole. As shown in FIG. 1, the partition member 6 is horizontally U-shaped and has a pair of side walls **6*a*, 6*a* extending longitudinally along outer longitudinal edges of the electrodes 5A and 5B, and an end wall 6*b* extending transversely across the common electrode 5B. Each of the side walls 6*a* lies in a plane perpendicular to the plane of the heat-insulating layer 2. The heat-insulating layer 2, partition member 6 and nozzle plate 4 jointly define therebetween a pressure chamber 7 which solely constitutes an ink tank. The pressure chamber 7 (ink tank) communicates with an ink passage 8 provided at a signal electrode 5A side of the ink-jet head so that a conductive ink having a predetermined volume resistivity is introduced into the pressure chamber 7 via the ink passage 8. Designated at 10 in FIG. 2 is a pulse voltage generator by means of which a voltage supplied from a DC power supply 11 is selectively applied to the opposed electrodes 5**.

Figure 4:
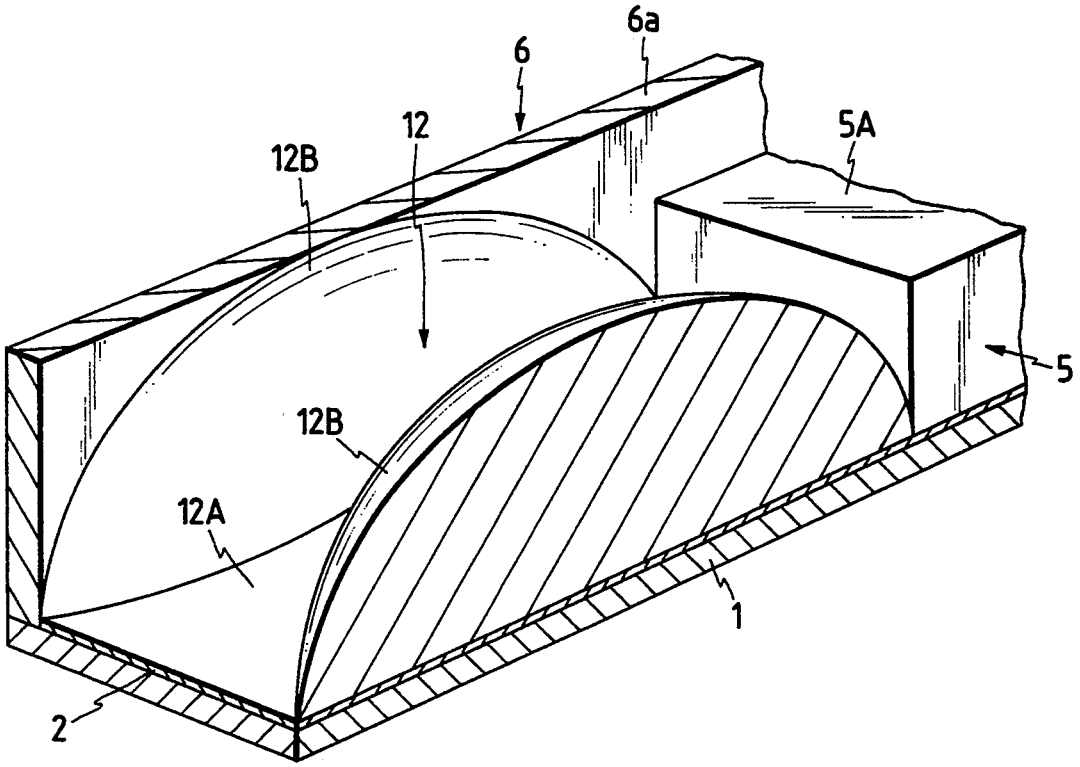
FIG. 4 is a schematic perspective view, with parts cutaway for clarity, of a main portion of the ink-jet head.

The ink-jet head of this invention further includes a converging means 12 made of an electrically insulating material and disposed between the signal electrode 5A and the common electrode 5B for increasing the density of a current flowing between the signal electrode 5A and the common electrode 5B. As best shown in FIG. 4, the convergent means 12 has a generally saddle-like shape including a first projection 12A disposed between two opposed second projections 12B, 12B. The first projection 12A is in the form of a convex resembling a part of a sphere and is disposed on the heat-insulating layer 2, while the second projections 12B, 12B also in the form of a convex resembling a part of a sphere are disposed on the side walls **6*a*, 6*a*, respectively, of the partition member 6. Thus, the first projection 12A projects from a plane perpendicular to the plane of each of the second projections 12B. As shown in FIG. 2, the first convex projection 12A has a peak or apex having the same height as the electrodes 5A, 5B and sloping down toward the opposed electrodes 5A and 5B. The apex is disposed at a point F directly below (or aligned with) a center of the discharge hole 3 and located at the same level as the upper surfaces of the electrodes 5A, 5B. Each of the second convex projections 12B has a peak or apex merging with the apex of the first convex projection 12A at the point F and sloping down toward the opposed electrodes 5A and 5B and toward the nozzle plate 4. Thus, the first convex projection 12A and the pair of second convex projection 12B converge at the point F. In this instance, the second projections 12B define therebetween a recess 13 (FIG. 3) extending over the first projection 12A in the direction parallel to a common longitudinal axis of the opposed electrodes 5. In FIG. 2, the reference character B designates an electric line of force (electric flux line) passing through the conductive ink contained between the signal electrode 5A and the common electrode 5B when a voltage is applied to these electrodes 5A and 5B**.

The ink-jet head of the foregoing construction operates as follows.

The pulse voltage generator 10 is operated to apply a voltage between the signal electrode 5A and the common electrode 5B, whereupon electric lines B of force are produced, passing through a current flow channel C between the signal electrode 5A and the common electrode 5B, as shown in FIG. 2. Thus, a current flows through the conductive ink along the electric lines B of force. In this instance, since the converging means 12 is disposed within the pressure chamber 7, the electric lines B of force are deflected or bent upwardly along the shape of the first convex projection 12A while being constricted in the widthwise direction of the electrodes 5A, 5B by means of the second convex projections 12B. The density of the electric lines B of force increases with the angle of deflection of the electric lines B of force, so that the density of the electric lines B of force become maximum at the point F, namely at the apex of the first convex projection 12A. On the other hand, the current density (i.e., the density of the current flowing along the electric lines B of force ) varies inversely as the length of the electric lines B of force, so that the current density in the widthwise direction of the electrodes 5A, 5B becomes maximum at the point F. This means that Joule heat generated by an $I^2R$ loss in the conductive ink becomes maximum at the point F. Consequently, as the time goes on, the temperature of the conductive ink contained in the current flow channel C rises to a maximum value at the point F. With this temperature rise, the conductive ink is caused to become vaporized. Vaporization or boiling begins at fine pits existing in the surface of the convergent means 12 adjacent to the point F and a single bubble is formed, which bubble will expand thereafter. In the early stages of expansion of this bubble, tiny bubbles may be produced in the vicinity of the point F, however, these tiny bubbles are united with the first-generated bubble as they expand. The bubble is an insulator, so that when the bubble expands in excess of a predetermined size, it blocks the current from passing through the point F. Thus, the current tends to flow intensely along the surface of the bubble, so that expansion of the bubble is accelerated. With this accelerated expansion of the bubble, the pressure in the pressure chamber 7 rises suddenly, forcing the conductive ink toward the ink passage 8 and the discharge hole 3. In this instance, the sudden pressure rise in the pressure chamber 7 cannot be taken up only by the movement of the conductive ink toward the ink passage 8. Accordingly, that part of the conductive ink existing in the discharge hole 3 is forced out through a meniscus of the conductive ink and jets from the discharge hole 3 in the form of a droplet 9 onto the surface of a recording paper (not shown), thus producing a well-defined spot or dot on the recording paper.

When the bubble expands to a maximum size, a substantial part of the current flow portion C is occupied by the electrically insulating bubble. This causes a sudden drop in current value flowing between the signal electrode 5A and the common electrode 5B. Consequently, heat of the bubble is taken up by the surrounding conductive ink, partition member 6 and convergent means 12, causing the bubble to contract and disappear suddenly. Thus, the bubble is cooled down from all over the surface thereof, so that the bubble disappears in the conductive ink. At this moment, a negative pressure or suction is produced, causing the conductive ink to become stirred and thereby lowering the temperature of the conductive ink in the vicinity of the point F of the current flow portion C. The signal electrode 5A and the common electrode 5B are kept at the same potential for, at least, several microseconds by means of the pulse voltage generator 10 so as to prevent reboiling of the conductive ink at the point F which would otherwise occur due to generation of heat of the conductive ink when a current flows between the electrodes 5A and 5B.

After the ejection of the conductive ink, an adequate amount of conductive ink is automatically replenished from the ink passage 8 into the pressure chamber 7 by the action of the surface tension of the conductive ink so that the meniscus of the conductive ink raises at a level which is in balance with the back pressure. Thus, the ink-jet head returns to the stand-by state. In this instance, the conductive ink in the pressure chamber 7 still evolves a slight amount of heat which in turn will be taken up by the opposed electrodes 5, convergent means 12 and partition member 6 during the stand-by condition. Thus, the conductive ink is cooled down to its initial temperature. The foregoing cycle of operation is repeated to produce droplets 9 of ink in succession in accordance with signals so that a particular form of the characters composed of dots can be formed on the recording paper.

Figure 5:
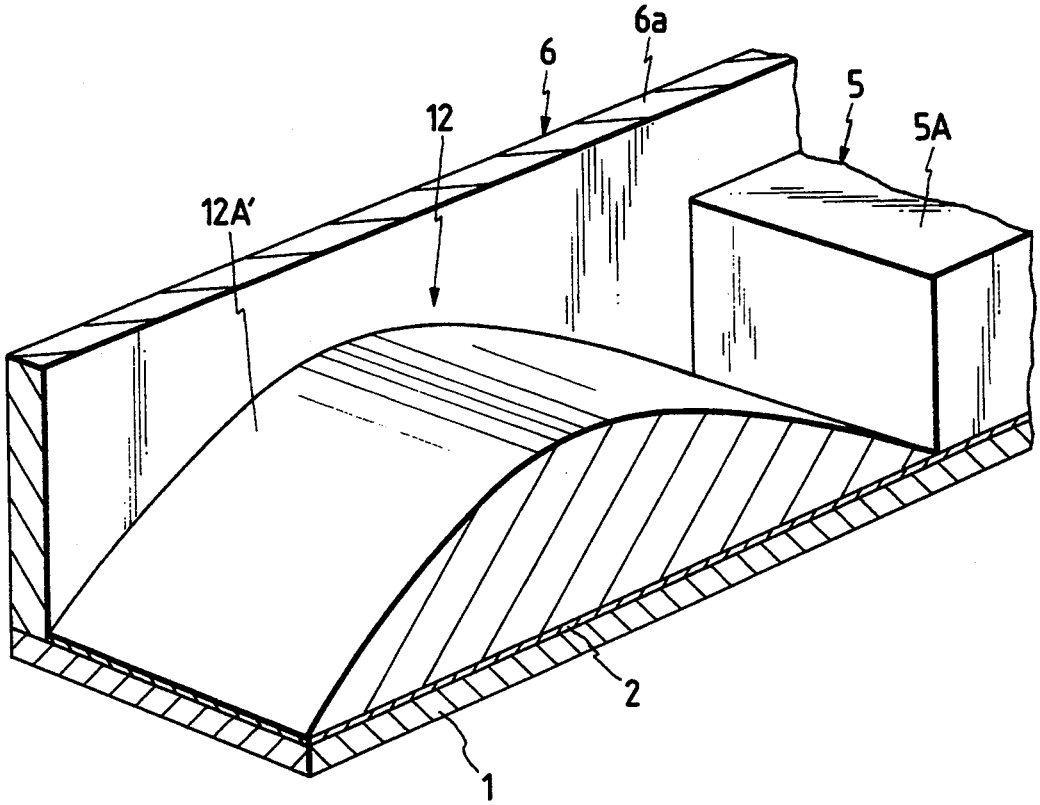
FIG. 5 is a view similar to FIG. 4, but showing a main portion of a modified ink-jet head.
Figure 6:
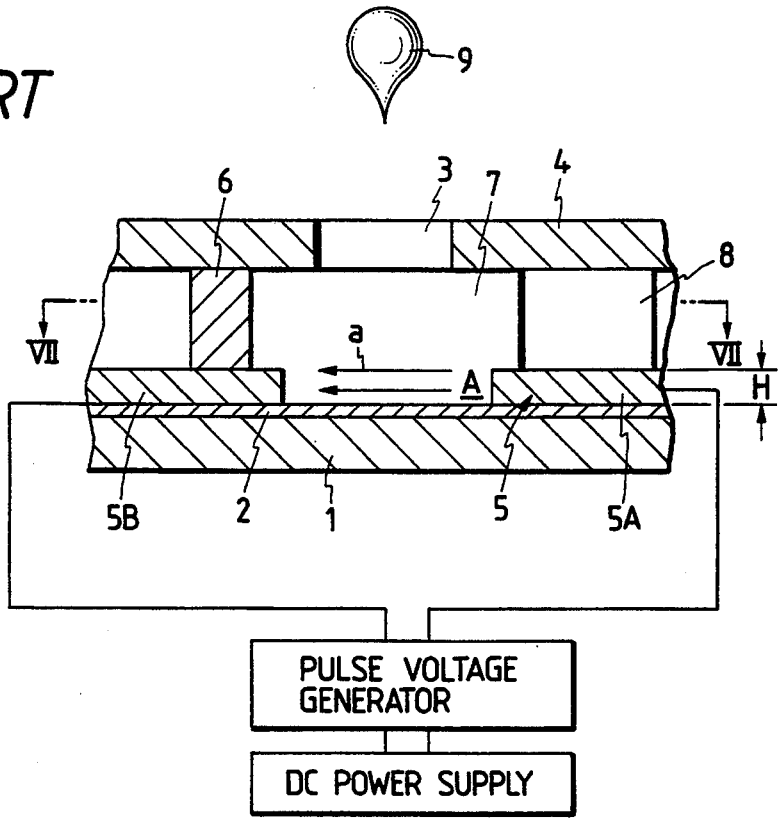
FIG. 6 PRIOR ART
FIG. 6 is a view similar to FIG. 2, but showing a conventional ink-jet head.
Figure 7:
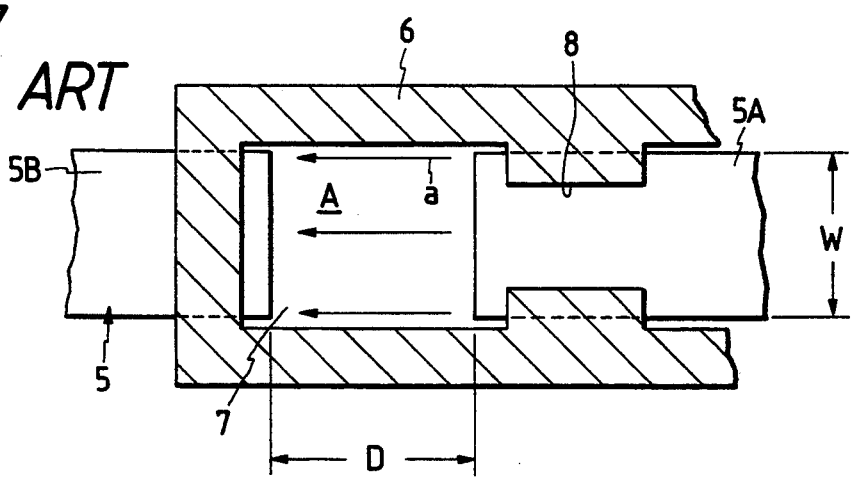
FIG. 7 PRIOR ART
FIG. 7 is a cross-sectional view taken along line VII—VII of FIG. 6.

In the embodiment described above, the converging means 12 has a generally saddle-like shape. This is not restrictive but rather illustrative. The converging means 12 may have any suitable form provided that the form used is able to increase or intensify the current density at any given point of the current flow channel C to a maximum. For example, either the first convex projection 12A or the pair of second convex projections 12B may be omitted. The number of the first convex projection 12A and the pair of second convex projections 12B is not limited to one; and two or more sets of first and second convex projections 12A and 12B may be employed. In addition, the shape of the convex projections 12A, 12B is not limited to a part of a sphere as employed in the illustrated embodiment, but a cylindrical shape may be used for forming the first and second convex projections 12A and 12B, as shown in FIG. 5 (only the first convex projection 12A') being shown). If the cylindrical first convex projection 12A is used, a peak or apex of the convex projection 12A extends in a direction perpendicular to a common longitudinal axis of the signal electrode 5A and the common electrode 5B.

If the electric lines B of force are bent excessively, the electric lines B of force are elongated or lengthened considerably with the result that the current value between the opposed electrodes 5 is decreased. In order to concentrate the electric lines B of force lines, thereby increasing the current density at the point F efficiently while maintaining the current value above a certain level, it is preferable that the first convex projection 12A has the same height as the opposed electrodes 5.

In addition, the second convex projections 12B are preferably arranged such that the recess 13 defined between the second convex projections 12B is confined or contracted at a position directly below the discharge hole 3. With the second convex projections 12B thus arranged, the pressure exerted by the conductive ink existing directly above the bubble can be used up with a maximum efficiency for the production of an ink droplet 9. The ink droplets 9 thus produced are ejected stably in a uniform direction.

The converging means 12 is preferably made of a porous material such as a porous ceramic of aluminum oxidebase, or a porous plastic such as one commercially available under the trade name "Isotore Filter" manufactured by Millipore Limited. Due to the presence of controlled pores, such a porous material is able to control a critical radius of a bubble core produced in nucleate boiling and thereby provide an excellent repeatability of a predetermined boiling pressure. Preferably, the design size of the pores is larger than the size of pits produced in the course of manufacture processes. Other plastic material and electrically insulating materials may be used for the convergent means 12.

In the illustrated embodiment, the voltage applied to the signal electrode 5A and the common electrode 5B is a DC voltage. This is not restrictive but rather illustrative. Any voltage waveform other than the DC waveform may be used without affecting the advantageous effects attained by the present invention.

As described above, the ink-jet head of this invention includes a nozzle plate having a plurality of discharge holes (nozzles) for ejecting small jets of a conductive ink, a plurality of pairs of opposed electrodes each disposed at a position corresponding to the position of one of the discharge holes, a pressure chamber (ink tank) provided between each pair of opposed electrodes, a voltage application means for applying an exciting voltage to the opposed electrode pairs, and a converging means of electrically insulating material disposed in the pressure chamber in the form of at least one projection located between the opposed electrodes for increasing the density of electric lines of force at a given position in the pressure chamber. With this arrangement, boiling of the conductive ink takes place at the given position. This means that the volume of that portion of the conductive ink which is participated in the generation of heat is very small and, hence, the wasted power dissipated as heat in the ink-jet head is substantially reduced. In addition, only a small volume portion of the conductive ink is subjected to boiling, so that the direction and size of droplets of ink ejected from the discharge holes can be controlled stably and reliably.

Furthermore, boiling of the conductive ink takes place at a position remote from the opposed electrodes. Thus, the electrodes are substantially free from cavitation and thermal shock and, therefore, have a long life span. Since the boiling does not take place at the confronting surfaces of the electrodes, the electrodes are substantially free from corrosion which would otherwise occur due to a deposit of impurities contained in the conductive ink. In addition, the electrodes do not require a precise finishing and hence can be manufactured at a low cost. Due to a very small volume of the conductive ink participated in the generation of heat, thermal history or hysteresis of the conductive ink is small so that fluctuations of pulse width of the applied voltage are small. It is, therefore, no longer necessary to take the voltage-application history into consideration when an electric circuit is designed.

Obviously, various minor changes and modifications of the present invention are possible in the light of the above teaching. It is therefore to be understood that within the scope of the appended claims the invention may be practiced otherwise than as specifically described.

What is claimed is:

1. An ink-jet head for an ink-jet printer, comprising:
an ink tank for holding therein a conductive ink;
a nozzle provided in a nozzle plate located at a position on said ink tank for allowing ejection of a droplet of said conductive ink;
a pair of electrodes disposed on an inside surface of said ink tank at a position corresponding to the position of said nozzle;
first means for applying a voltage to said pair of electrodes to cause a current having a current density to be passed through said conductive ink contained between said pair of electrodes; and
second means disposed between said electrodes and including a projection having a peak sloping down toward said pair of electrodes for maximizing the current density at the peak.

2. An ink-jet head for an ink-jet printer, comprising:
an ink tank for holding therein a conductive ink;
a nozzle provided in a nozzle plate having a center and located at a position on said ink tank for allowing ejection of a droplet of said conductive ink;
a pair of electrodes disposed on an inside surface of said ink tank at a position corresponding to the position of said nozzle;
first means for applying a voltage to said pair of electrodes to cause a current having a current density to be passed through said conductive ink contained between said pair of electrodes; and
second means disposed between said electrodes for increasing the current density of said current, said second means including a projection made of an electrically insulating material and disposed between said pair of electrodes, said projection having a peak sloping down toward said pair of electrodes; and disposed directly below the center of the said nozzle.

3. An ink-jet head according to claim 2, wherein said projection is in the form of a convex body resembling a part of a sphere.

4. An ink-jet head according to claim 2, wherein said projection is in the form of a convex body resembling a part of a cylinder and having a peak extending in a direction perpendicular to a common longitudinal axis of said pair of electrodes.

5. An ink-jet head according to claim 2, wherein said peak lies flush with upper surfaces of said pair of electrodes.

6. An ink-jet head according to claim 2, wherein said projections is porous.

7. An ink-jet head for an ink-jet printer, comprising:
an ink tank for holding therein a conductive ink;
a nozzle provided in a nozzle plate having a center and located at a position on said ink tank for allowing ejection of a droplet of said conductive ink;

a pair of electrodes disposed on an inside surface of said ink tank at a position corresponding to the position of said nozzle;

first means for applying a voltage to said pair of electrodes to cause a current having a current density to be passed through said conductive ink contained between said pair of electrodes; and second means disposed between said electrodes for increasing the current density of said current, said second means including a pair of projections made of an electrically insulating material, said projections confronting and merging with one another and having peaks sloping down toward said pair of electrodes, said peaks of said pair of projections defining a recess extending along a common longitudinal axis of said pair of electrodes, said peaks being disposed directly below the center of said nozzle and merging with each other.

8. An ink-jet head according to claim 7, wherein said pair of projections are porous.

9. An ink-jet head for an ink-jet printer, comprising:

an ink tank for holding therein a conductive ink;

a nozzle provided in a nozzle plate having a center and located at a position and on said ink tank for allowing ejection of a droplet of said conductive ink;

a pair of electrodes disposed on an inside surface of said ink tank at a position corresponding to the position of said nozzle;

first means for applying a voltage to said pair of electrodes to cause a current having a current density to be passed through said conductive ink contained between said pair of electrodes; and second means disposed between said electrodes for increasing the current density of a said current, said second means including a first projection made of an electrically insulating material and disposed between said pair of electrodes, and two confronting second projections made of an electrically insulating material and projecting between said pair of electrodes from a pair of first planes, respectively, extending perpendicular to a second plane from which said first projection projects, said first projection having a peak sloping down toward said pair of electrodes, said second projections having peaks defining therebetween a recess extending above said first projection in a direction parallel to a common longitudinal axis of said pair of electrodes.

10. An ink-jet head according to claim 9, wherein said peak of said first projection is disposed centrally between said pair of electrodes.

11. An ink-jet head according to claim 10, wherein said peaks of said second projections are disposed centrally between said pair of electrodes.

12. An ink-jet head according to claim 9, wherein said peak of said first projection is disposed directly below the center of said nozzle.

13. An ink-jet head according to claim 12, wherein said peaks of said second projections are disposed directly below said nozzle.

14. An ink-jet head according to claim 9, wherein said first projection is in the form of a convex body resembling a part of a sphere.

15. An ink-jet head according to claim 14, wherein said second projections are in the form of a convex body resembling part of a sphere

16. An ink-jet head according to claim 9, wherein said first projection is in the form of a convex body resembling a part of a cylinder and having a peak extending in a direction perpendicular to a common longitudinal axis of said pair of electrodes.

17. An ink-jet head according to claim 9, wherein said peak of said first projection lies flush with upper surfaces of said pair of electrodes.

18. An ink-jet head according to claim 17, wherein said peaks of said second projection lie in the same level as upper surfaces of said pair of electrodes.

19. An ink-jet head according to claim 9, wherein said peaks said second projections merge with each other.

20. An ink-jet head according to claim 19, wherein said peak of said first projection merges with said peaks of said second projections.

21. An ink-jet head according to claim 9, wherein said first and second projections are porous.

22. An ink-jet head for an ink-jet printer, comprising:

an ink tank for holding therein a conductive ink;

a nozzle provided in a nozzle plate on said ink tank for allowing ejection of a droplet of said conductive ink;

first means for providing a voltage;

a pair of electrodes, disposed within said ink tank, electrically connected to said first means, said electrodes having end surfaces opposite each other which are responsive to the voltage from said first means to produce electric lines of force therebetween so that a current having a current density passes through the conductive ink along the electric lines of force; and second means disposed between said electrodes, said second means being geometrically oriented to have a projection including a peak which is located in alignment with said end surfaces of said pair of electrodes, said second means for causing the electric lines of force to be constricted so that the current density of said current passing through the conductive ink is increased.

23. An ink-jet head according to claim 22, wherein said projection is made of an electrically insulating material, said peak being defined between surfaces inclined toward said pair of electrodes.

24. An ink-jet head according to claim 23, wherein said peak is disposed centrally between said pair of electrodes.

25. An ink-jet head according to claim 23, wherein said projection includes a convex body resembling part of a sphere.

26. An ink-jet head according to claim 23, wherein said peak is flush with edges of said end surface of the pair of electrodes adjacent said nozzle.

27. An ink-jet head according to claim 23, wherein said projection is porous.

28. An ink-jet head according to claim 23, wherein said second means further includes a pair of second projections, said second projections being arranged opposite each other to define a path along which the electric lines of force extend over said peak of said projection.

29. An ink-jet head according to claim 28, wherein said second projections include a convex body resembling part of a sphere.

30. An ink-jet head for and ink-jet printer, comprising:

an ink tank for holding therein a conductive ink;

a nozzle provided in a nozzle plate located at a position said ink tank for allowing ejection of a droplet of said conductive ink;

a pair of electrodes disposed on an inside surface of said ink tank at a position corresponding to the position of said nozzle;

first means for applying a voltage to said pair of electrodes to cause a current having a current density to be passed through said conductive ink contained between said pair of electrodes; and second means disposed between said electrodes for increasing the current density of said current only at a preselected position defined between said pair of electrodes;

wherein said preselected position is three-dimensionally determined.

31. An ink-jet head for an ink-jet printer, comprising:

an ink tank for holding therein a conductive ink;

a nozzle provided in a nozzle plate located at a position said ink tank for allowing ejection of a droplet of said conductive ink;

a pair of electrodes disposed on an inside surface of said ink tank at a position corresponding to the position of said nozzle;

first means for applying a voltage to said pair of electrodes to cause a current having a current density to be passed through said conductive ink contained between said pair of electrodes, said electrodes having confronting surfaces of equal area; and second means disposed between said electrodes for increasing the current density of said current only at a preselected position defined between said pair of electrodes.

* * * * *